United States Patent [19]

Nielsen

[11] Patent Number: 4,552,567

[45] Date of Patent: Nov. 12, 1985

[54] PRESSURE ROLLER APPARATUS FOR BRIQUETTING CUT MATERIAL OF BIOLOGICAL ORIGIN SUCH AS GREEN CROPS, WOOD FLAKES OR PEAT

[76] Inventor: Alfred T. Nielsen, No. 4 Lyngskraenten, 2840 Holte, Denmark

[21] Appl. No.: 686,262

[22] PCT Filed: Apr. 25, 1984

[86] PCT No.: PCT/DK84/00033

§ 371 Date: Dec. 5, 1984

§ 102(e) Date: Dec. 5, 1984

[87] PCT Pub. No.: WO84/04276

PCT Pub. Date: Nov. 8, 1984

[30] Foreign Application Priority Data

Apr. 27, 1983 [DK] Denmark ..... 1872/83

[51] Int. Cl.[4] ..... B30B 11/20; B30B 3/00

[52] U.S. Cl. ..... 44/13; 44/2; 44/30; 100/155 R

[58] Field of Search ..... 44/2, 11–13, 44/27–30; 100/155 R, 156, 157, 159

[56] References Cited

U.S. PATENT DOCUMENTS 1,294,218 2/1919 Anchersen ..... 44/28
1,566,496 12/1925 Maus ..... 44/27

FOREIGN PATENT DOCUMENTS 979962 5/1951 France ..... 44/30
854973 8/1981 U.S.S.R. ..... 44/1 D

*Primary Examiner*—Carl F. Dees
*Attorney, Agent, or Firm*—Browdy and Neimark

[57] ABSTRACT

The rear end of a rotary drying drum (1) is provided with a peripheral channel (10) in which dried material to be briquetted, such as green crops, wood flakes or peat, is accumulated and carried along. The bottom of the channel (10) is formed by the inner periphery of a ring of dies (18), in which the formation of briquettes takes place by means of a pressure roller (17) operating in the channel (10) and compressing the material against the frictional resistance in the dies.

The material has previously been precompressed by an endless band (19) likewise operating in the channel (10), which band preferably runs at the same peripheral speed as the pressure roller (17) and the inner side of the die ring (18).

4 Claims, 3 Drawing Figures

Figure 1:
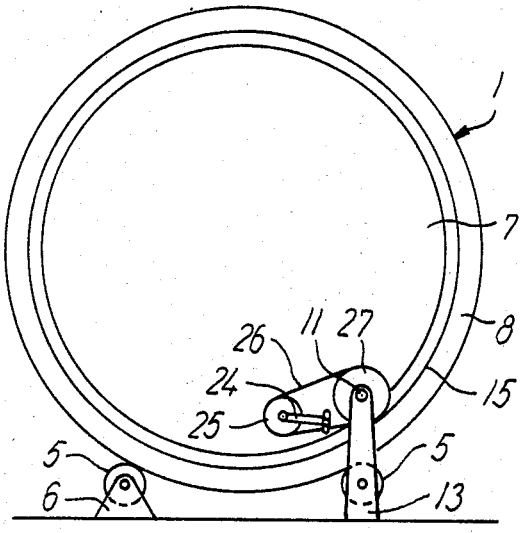

PRESSURE ROLLER APPARATUS FOR BRIQUETTING CUT MATERIAL OF BIOLOGICAL ORIGIN SUCH AS GREEN CROPS, WOOD FLAKES OR PEAT

The invention relates to a pressure roller apparatus for briquetting cut material of biological origin such as green crops, wood flakes or peat.

Such apparatus, which has in practice been used for the manufacture of fodder briquettes (so-called cubes) from biological material mainly consisting of lucerne and having a grass content of not more than 10%, is known from the specification of British Patent No. 1 007 152. In this apparatus the material is collected from the field after sufficient tedding and is cut, after which it is precompressed and led into the cleft or nip between a pressure roller and a surrounding rotary ring with radial die openings. In this cleft considerable rearrangement and further compression of the cut material occurs before the latter is squeezed by the roller into the die openings where the actual briquetting takes place under counter-pressure arising partly from friction against the walls of the die, partly from a narrowing of the cross section of the die openings from the inlet end to the outlet end.

The frictional resistance is influenced in opposite directions by the water and adhesive content of the material, the water having a lubricating effect, whereas the adhesive under the pressure of briquetting has a tendency to travel outwards towards the wall of the die resulting in an increased friction. This increase is of decisive importance for the briquetting capacity of the apparatus, and since the increase is itself dependent on the adhesive content of the briquetting material, the apparatus will give a satisfactory result only when working with material having certain specific properties, such as lucerne, and under certain conditions as regards its moisture content. The patent specification refers to a moisture content in the area of 15–35%, but for obtaining storageresistant fodder briquettes the water content should not exceed 10–12%. Such a low water content after natural drying can only be expected to be obtained in areas with a decided continental climate, and even under ideal conditions the water content will often vary considerably in the collected material, for which reason intensive mixing should be carried out in connection with the cutting operation. Despite this, certain parts of the material may become over-dried, and in practice the apparatus has therefore been further equipped with manually controlled means for the addition of water as deemed necessary. It is evident from this that variations in briquetting quality resulting from variations in the water content of the material will not be avoidable in practice.

A further condition of high-quality briquetting is that the supply of the material be correctly controlled and in particular be kept fairly constant. This is also important in order to prevent overloading and to minimize the power requirements for the operation of the apparatus. In the known apparatus the said cleft is open at one side and the material is supplied into this open side by means of an endless belt or a worm conveyor, which is at the same time responsible for the precompression, which consequently takes place mainly parallel to the axial directions of the pressure roller and the die ring and thus at right angles to the direction of the briquetting.

A drawback of this known briquetting principle, which is partly due to extrusion of the material through tapering die openings, is that considerable and energy-consuming rearrangement of the material takes place both during precompression and ultimate compression, which as stated mainly occur at right angles to each other and, in particular, the rearrangement in the actual briquetting stage, i.e. during extrusion through the die openings, is disadvantageous, because the displacement between the pieces of the material prevents the adhesive content from sticking these pieces firmly together. The extruded briquettes will thus expand considerably, and they obtain only a poor mechanical strength.

A purpose of the invention is to provide a briquetting apparatus in which the conditions decisive of the briquette quality and the power consumption, particularly the water content and temperature of the material, possibly its composition (for example, of leaves, stems and glumes), the rate of supply and the time it spends in the die openings, and its flow therethrough, as well as the briquetting pressure, can be controlled and regulated in such manner that, independently of local climatic conditions, optimum briquetting can be carried out of not only all kinds of green crops, including hay and straw with an extremely low sap content, but also other kinds of biological material and particularly wood flakes and peat with a view to manufacturing fuel briquettes.

Starting from the above-mentioned technique the invention relates to a pressure roller apparatus for briquetting cut and dried material of biological origin, such as green crops, wood flakes or peat, through radial die openings formed in the bottom of an inwardly open material supply channel provided in a circular rotary ring, the cross section of the channel at the briquetting zone being virtually filled out by a pressure roller journalled on a stationary axis, and the channel being associated with a mechanism for precompressing the material upstream of this pressure roller. According to the invention such apparatus is characterized in that the ring with die openings is localized at, and firmly connected to, the rear end of a rotary drying drum, and in that the precompression mechanism comprises an endless band coplanar with the material supply channel and passing around both a stationarily journalled disc and a disc located nearer to the pressure roller, the latter disc being entered into the material supply channel and being adjustable and elastically urged against its bottom, and the endless band being drivable at the same peripheral speed as the channel bottom.

Rotary drying drums operating with a flow of heated air therethrough have been known for a number of years for humidity conditioning of, for example, grass to be briquetted, and have the advantage that the different parts of the material (leaves, stems and glumes) can be dried so as to have virtually the same water content and can be delivered in an easily adjustable flow, in which the proportion of the different components is well-defined. In the known use the dried material is passed through a cyclone or other air separator to an extruder, which compresses the material and discharges it in the form of a string, which under controlled cross-expansion is led through a long cooling tube and is then broken to pieces.

In comparison therewith the apparatus according to the invention is simplified considerably, among other things, because the air separation takes place inside the drying drum, and because the rotary movement of the latter is directly utilized in the briquetting phase. Add to this that the apparatus is not only energy-saving, because precompression and ultimate compression take place in the same direction, but also permits optimum utilization of the sap content of the material as an adhesive in the completed briquettes, because the ultimate compression in the die openings can be carried out without any appreciable lateral displacement between the pieces of material parts, and for a suitably long period, e.g. 30 secs, and at a suitable temperature, whereby the adhesive effect of the sap is fully utilized and eliminates at least a considerable part of the elasticity in the straw or fibre components of the material. Furthermore, almost any kind of biological material could be briquetted in the same apparatus and without replacement of dies or other elements, provided that the die length is sufficient for briquetting the material that is most difficult to compress. In practice, with a square die section a die length of at least five times the side length will normally be sufficient. Compression of the material prior to the actual briquetting permits extensive regulation of the density of the material at the point of entry to the dies thus benefiting the transverse pressure built up therein, whereby a high frictional resistance is obtained at an early stage.

Figure 2:
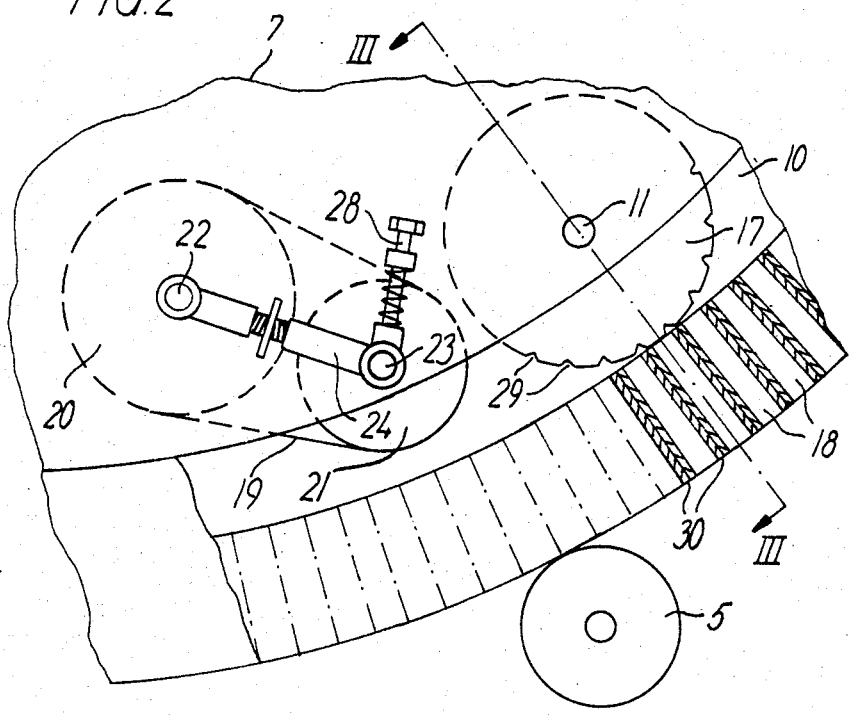
Figure 3:
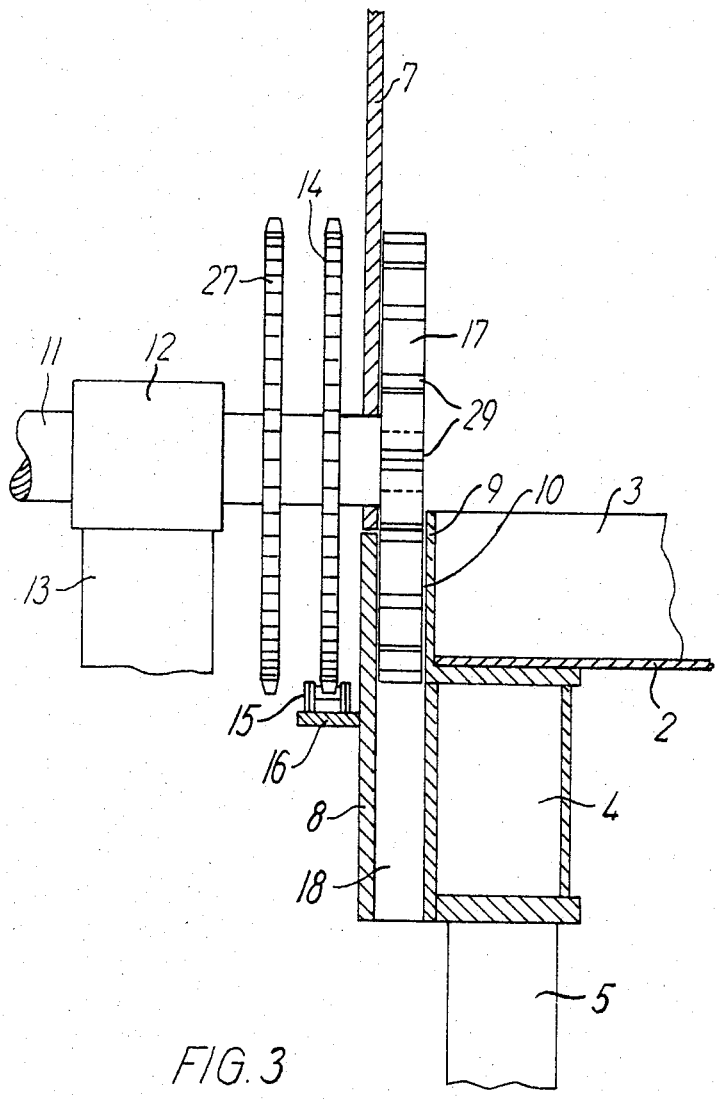

Further details of the apparatus according to the invention will appear from the following description of an embodiment thereof with reference to the mainly schematic drawing, in which FIG. 1 is an end view of the apparatus FIG. 2 a part of FIG. 1 on a larger scale, with certain portions removed and the die ring shown partly in radial section, and FIG. 3 a section on an even larger scale on the line III—III in FIG. 2.

The apparatus comprises a drying drum 1 that can be constructed mainly in the known manner with a cylindrical wall 2 and internal guide vanes and lifters 3, FIG. 2, as well as equipment, not shown, for feeding cut material to the drum at its front end and for providing an adjustable heated air current through the drum. The drum rests through bearing rings 4 on supporting rollers 5 in brackets 6.

At its rear end the drum is closed by a stationary end wall 7, encircled by a ring 8 rigidly connected with the drum wall and forming together with an internal ring 9 a peripheral canal 10 which is open towards the axis of the drum and receives the material dried in the drum from the vanes and lifters 3.

The drum is operated by a motor, not shown, with a shaft 11 journalled in a bearing 12 on a frame 13, which is rigidly connected with the bracket of one of the supporting rollers 5. The shaft 11 has a fixed sprocket 14 in mesh with a chain 15, which is welded to a circular flange 16 on the ring 8.

The shaft 11 extends through the stationary end wall 7 into the drum and carries a pressure roller 17 operating in the material supply channel 10 and having its periphery quite close to the channel bottom, which is formed by a ring of radially orientated dies 18, lying between the bearing ring 4 of the drum and the co-rotating ring 8.

Also a precompressor comprising an endless band 19 running around a disc 20 with a stationary axis and a disc 21 situated closer to the pressure roller 17 operates in the supply channel 10. These discs 20 and 21 sit on shafts 22 and 23 journalled in external bearings which are connected with each other through a rod 24, variable in length, which permits re-tightening of the band 19. Outside the stationary end wall 7 the shaft 22 carries a driving wheel 25, which through a chain 26 is drawn from a sprocket wheel 27 on the motor shaft 11, and the bearing for the shaft 23 is connected with a spring-urged adjusting mechanism 28 permitting a regulation of the minimum distance from the band 19 to the bottom of the channel 10 formed by the die ring 18. The peripheral speeds of the pressure roller 17 and the precompression band 19 are preferably the same and equivalent to the peripheral speed of the inner side of the die ring 18.

During operation the material is precompressed in the channel 10, inasmuch as its height below the band 19 is gradually reduced, and the precompressed material is passed on to the mainly triangular channel zone in front of the pressure roller 17. The length of this zone is preferably made as short as possible by the distance between the disc 21 and the pressure roller 17 not being made greater than necessary. From the said triangular channel zone resulting in a substantially constant precompression, the material is taken along by the pressure roller 17, which at its periphery has recesses 29, which intensify the grip on the material and during rotation become radially opposite to the partitions 30 of the dies 18. Hereby the risk of direct contact between the pressure roller and the die ring is avoided.

The briquettes formed under the frictional resistance in the dies may be divided into pieces of suitable length by being broken off mainly coplanar with the outer periphery of the die ring and can from the place of breaking-off fall directly down into a truck as a storage-proof product.

I claim:

1. Pressure roller apparatus for briquetting of cut and dried material of biological origin, such as green crops, wood flakes or peat, through radial die openings (18) formed in the bottom of an inwardly open material supply channel (10) provided in a circular rotary ring, the cross section of the channel at the briquetting zone being virtually filled out by a pressure roller (17) journalled on a stationary axis, and the channel being associated with a mechanism (19, 21) for precompressing the material upstream of this pressure roller, c h a r a c t e r i z e d in that the ring with die openings (18) is localized at, and firmly connected to, the rear end of a rotary drying drum (1), and in that the precompression mechanism comprises an endless band (19) coplanar with the material supply channel (10) and passing around both a stationarily journalled disc (20) and a disc (21) located nearer to the pressure roller (17), the latter being entered into the material supply channel and being adjustable and elastically urged against its bottom, and the endless belt being drivable at the same peripheral speed as the channel bottom.

2. Apparatus according to claim 1, c h a r a c t e r i z e d in that the precompression band (19) is placed at a minimum distance from the periphery of the pressure roller (17).

3. Apparatus according to claim 1, c h a r a c t e r i z e d in that the pressure roller (17) at its periphery has recesses (29), which during rotation become radially opposite to the partitions (30) of the dies.

4. Apparatus according to claim 1, c h a r a c t e r i z e d in that the length of the die openings (18) is at least five times their width.

* * * * *